US006178785B1

(12) United States Patent
Samata

(10) Patent No.: US 6,178,785 B1
(45) Date of Patent: Jan. 30, 2001

(54) SOCKS AND KNITTING METHOD THEREFOR

(75) Inventor: Takashi Samata, Shizuoka (JP)

(73) Assignee: Naigai Co., Ltd., Tokyo (JP)

( * ) Notice: Under 35 U.S.C. 154(b), the term of this patent shall be extended for 0 days.

(21) Appl. No.: 09/610,658

(22) Filed: Jul. 5, 2000

(30) Foreign Application Priority Data

Dec. 10, 1999 (JP) ..... 11-351708

(51) Int. Cl.[7] ..... D04B 9/56
(52) U.S. Cl. ..... 66/186; 66/187; 2/239
(58) Field of Search ..... 66/178 R, 179, 66/180, 181, 182, 183, 184, 185, 186, 187; 2/239, 240, 241

(56) References Cited

U.S. PATENT DOCUMENTS 1,476,043 * 12/1923 Bosworth ..... 66/185
2,192,625 * 3/1940 Thurston et al. ..... 66/185
2,237,144 * 4/1941 Houseman ..... 66/185
2,512,728 * 6/1950 Thurston ..... 66/185
2,667,774 * 2/1954 Allen ..... 66/185
2,987,900 * 6/1961 Mahler ..... 66/185
3,601,818 * 8/1971 Chesebro et al. ..... 2/239
4,194,249 * 3/1980 Thorneburg ..... 2/239
5,103,656 * 4/1992 Hanson, II ..... 66/185

* cited by examiner

*Primary Examiner*—Danny Worrell
(74) *Attorney, Agent, or Firm*—Armstrong, Westerman, Hattori, McLeland & Naughton

(57) ABSTRACT

Socks having a rib top part, a leg part, a heel part, a foot part and a toe part which are knitted in order wherein first gore lines extending obliquely downwardly from upper portions of the heel part to rear portions of the heel part are formed on the heel part next to the leg part from first and second trapezoidal knit fabrics whose top sides are common to each other, and a third trapezoidal knit fabric having a top side whose length is equal to the length of a bottom side of the second trapezoidal knit fabric at portions of the first gore lines rather near to the toe part is knitted next to the second trapezoidal knit fabric. Further, a fourth trapezoidal knit fabric is knitted continuously to the bottom side of the third trapezoidal knit fabric, and second gore lines are formed between the bottom side of the third trapezoidal knit fabric and inclined sides of the fourth trapezoidal knit fabric of the socks.

5 Claims, 4 Drawing Sheets

SOCKS AND KNITTING METHOD THEREFOR

BACKGROUND OF THE INVENTION a. Field of the Invention

The present invention relates to socks, particularly to socks characterized in structure of a heel part thereof and a knitting method therefor.

b. Description of the Prior Art

While socks, such as sports socks, are used daily or when some sport is played, the heel part is liable to slip down when a wearing person moves violently or in a like case. The slipping down knit fabric accumulates at the foot part and deteriorates the wearing feeling, and with such socks as ankle socks, it sometimes deteriorates also the appearance.

Further, the knit fabric at a portion around the heel sometimes gives some tightened feeling to the wearing person and deteriorates the feeling of use of the socks, and this gives rise to pulling down of the knit fabric at the heel part during use and results in accumulation of the fabric at the sole part.

Therefore, ankle socks have been proposed wherein a projection like a dingdong in the form of a ball is provided at an upper edge of a heel part such that, when a person puts on the socks and then puts on shoes, the projections may engage with upper portions of the heel parts of the shoes to prevent the socks from slipping down into the shoes during walking. However, where this structure is employed, time and labor are required to attach the projections by sewing after the socks are knitted. Further, when slipping down of socks itself occurs during walking and the fabric at the heel part is pulled down and slips down, an upper edge of the heel part of the sock comes to be exposed just outside the shoe due to the projection, which deteriorates the wearing feeling very much, and it is difficult to prevent slipping down of the knit fabric during walking.

The knit fabric of a portion which surrounds the heel, that is, the heel part of socks, is knitted next to knitting of a leg part which is knitted circumferentially into a tubular form. However, upon knitting of the heel part, circumferential knitting of the leg portion is stopped, and knitting is performed by reciprocating rotations over one half circumference. Besides, at each of end portions of the reciprocating motions, the number of needles for knitting is decreased by one for each one reciprocating motion. As a result, a knit fabric of a trapezoidal shape is produced. After a predetermined number of reciprocating motions, now a stitch is increased for each one reciprocating motion conversely while loops at end portions which form inclined sides of the trapezoidal knit fabric knitted already as described above are knitted. Then, when the original knitting width is reached, the knitting of the heel part is stopped and circumferential knitting is started to start knitting of the foot part, thereby to make a swell of the heel part.

By the knitting described above, two symmetrical trapezoidal knit fabrics wherein the opposite side edges formed as inclined sides are connected to each other are produced, and this part serves as the heel part of the socks. Connected portions of the two trapezoidal knit fabrics appear linearly and are called gore line. When it is considered that even the swell of the heel part is not sufficient, also socks wherein a linear gore line is bifurcated at a lower end portion thereof such that it may have an inverted Y-shape and socks wherein a gore line has a shape of overlapping Y-shapes such that it looks like a bone of a fish have been proposed.

However, even if only an end of a gore line is bifurcated into a Y-shape to increase the heel part of the knit fabric, the knit fabric of the heel part is knitted from the beginning to the ending of reciprocating knitting over a half circumference described above, and cannot be formed as a knit fabric which embraces the heel portion of a foot over a wide range.

BRIEF SUMMARY OF THE INVENTION

Taking the foregoing into consideration, it is an object of the present invention to provide socks wherein a heel part is produced from a knit fabric, which have a surplus sufficient to embrace the heel portion of a foot, to prevent slipping down of the knit fabric at the heel part and slackening at the sole part during use and, even where the socks are ankle socks, the top-lines of them do not enter shoes.

A sock of the present invention has a rib top part, a leg part, a heel part, a foot part and a toe part which are knitted in order. A tubular portion having first gore lines extending obliquely downwardly from upper portions of the heel part to rear portions of the heel part is formed on the heel part next to the leg part from first and second trapezoidal knit fabrics whose top sides are common to each other. At portions of the tubular portion rather near to the toe part, a swelling portion including second gore lines positioned nearer to the foot part than the first gore lines and extending obliquely downwardly from upper front portions of the heel part to central portions of the heel part is formed from a third trapezoidal knit fabric having a top side whose length is equal to the length of a bottom side of the second trapezoidal knit fabric and having inclined sides connected by knitting to the last course of the leg part and a fourth trapezoidal knit fabric having a top side contiguous to a mid portion of a bottom side of the third trapezoidal knit fabric.

The socks are constructed such that the first gore lines are formed by knitting together opposing loops of opposing inclined faces of the first trapezoidal knit fabric and the second trapezoidal knit fabric, and the second gore lines are formed by knitting together opposing loops to close at end portions of a course which forms the bottom side of the third trapezoidal knit fabric and on the inclined sides of the fourth trapezoidal knit fabric which oppose to the bottom side of the third trapezoidal knit fabric.

The socks may be constructed such that opposing loops at end portions of a course which forms the bottom side of the third trapezoidal knit fabric and on the inclined sides of the fourth trapezoidal knit fabric which oppose to the bottom side of the third trapezoidal knit fabric are connected by knitting, and surplus loops among the loops on the inclined sides are connected by knitting to the loops of the last course of the leg part to form second gore lines of another embodiment.

The socks of the present invention having a rib top part, a leg part, a heel part, a foot part and a toe part which are knitted in order is formed such that inclined sides of a first trapezoidal knit fabric having a bottom side knitted next to the leg part and a second trapezoidal knit fabric having a top side common to that of the first trapezoidal knit fabric are connected by knitting to form a tubular portion having first gore lines extending obliquely downwardly from upper portions of the heel part to rear portions of the heel part, and a third trapezoidal knit fabric having a top side whose length is equal to the length of a bottom side of the second trapezoidal knit fabric is knitted next to the second trapezoidal knit fabric such that inclined sides thereof are connected, by knitting, to the last course of the leg part and then a fourth trapezoidal knit fabric having a top side which is a mid portion of a bottom side of the third trapezoidal knit fabric is knitted contiguously to the third trapezoidal knit fabric such that inclined sides of the fourth trapezoidal knit fabric are connected by knitting to wales at end portions of a course of a bottom side of the third trapezoidal knit fabric to form a swelling portion having second gore lines and. If surplus portions appear at the inclined sides of the fourth trapezoidal knit fabric upon connecting by knitting of the inclined sides of the fourth trapezoidal knit fabric, loops at end portions of the surplus portions are successively connected by knitting to loops of the last course of the leg part, thereby to form a swelling portion having second gore lines of another embodiment which bend in an L-shape. The second gore lines extend obliquely downwardly from upper front portions of the heel part to central portions of the heel part between the bottom side of the third trapezoidal knit fabric and the inclined sides of the fourth trapezoidal knit fabric.

DESCRIPTION OF THE PREFERRED EMBODIMENTS

An embodiment of the present invention is described below with reference to the drawings.

Figure 1:
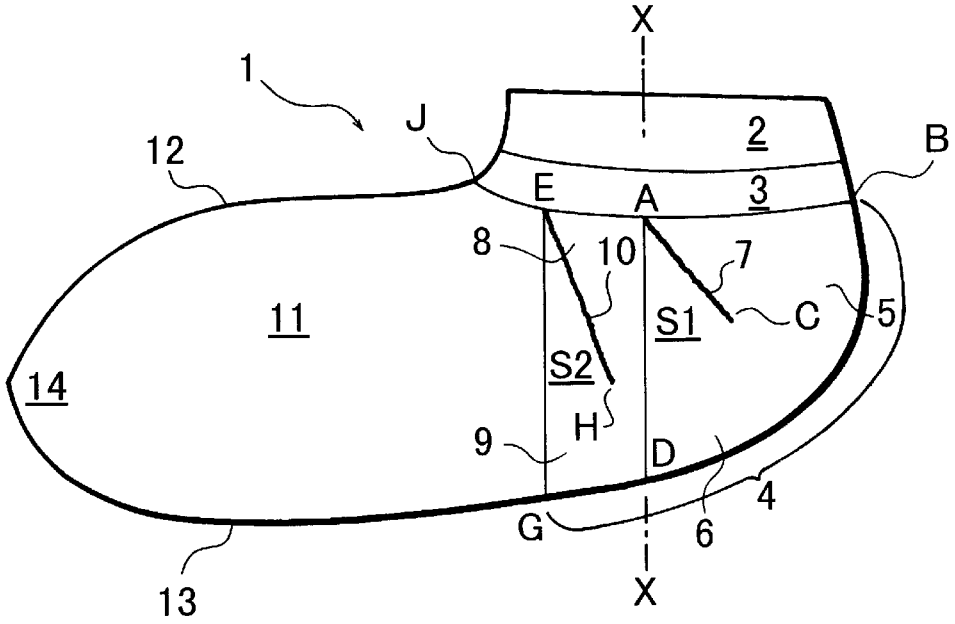
FIG. 1 is a side view of one embodiment of socks of the present invention.

FIG. 1 shows an example wherein the present invention is carried out for a sock 1 of an ankle height. In the sock 1 of the present invention, a rib top part 2 and a leg part 3 are continuously knitted in a tubular shape by a circular hosiery knitting machine. After the leg part 3 having a length suitable for the ankle sock 1 is knitted in a suitable number of circumferential courses, a heel part 4 is knitted. Whereas the leg part 3 is knitted circumferentially using all needles, the heel part 4 is knitted such that, with half the number of needles on the toe side raised to an inoperative position, the remaining needles are used to perform knitting which is reversed at the positions of points A, A' on an imaginary vertical center plane X which substantially passes the center of the leg part 3 shown in FIG. 1 and reciprocates like A, B, A', B, A, B, A', . . . passing a rib top part rear end B (refer to FIG. 7: a condition of the cylinder as viewed from below), and in the beginning of the knitting, the needles of the one half circle A, B, A' of the knitting machine cylinder NC are used for knitting while the cylinder NC make one half rotation in the opposite directions. In this instance, for each reciprocating motion, the needles (not shown) at the opposite ends of the knitting location are successively raised to the inoperative position (for example, one by one needle at the opposite ends for one course) to reduce the knitting width until the last course is knitted with the needles between C, C' shown in FIG. 7 thereby to knit a first trapezoidal knit fabric 5 wherein the bottom side is provided by A, B, A' and the top side is provided by C, C' within the range of A, A', C', C of the exploded view of the heel part 4 shown in FIGS. 4, 5 and 6. The needles raised to the inoperative position keep loops of the opposite end wales in the courses in which the knitting width is reduced.

Figure 4:
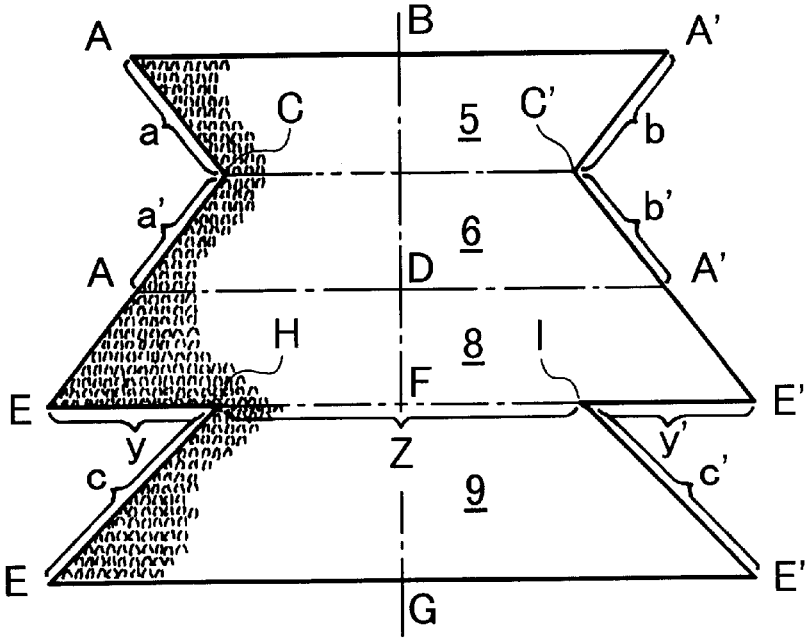
FIG. 4 is a plan view of a knit fabric of a heel part.
Figure 5:
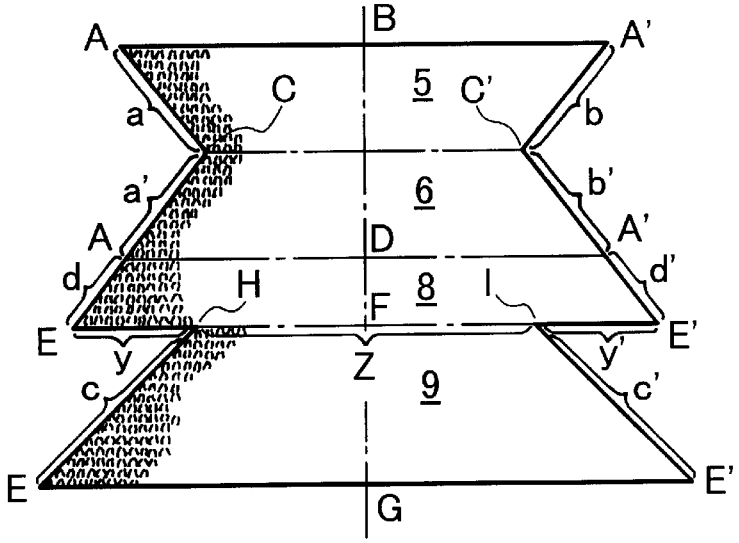
FIG. 5 is a plan view of another knit fabric of a heel part.
Figure 6:
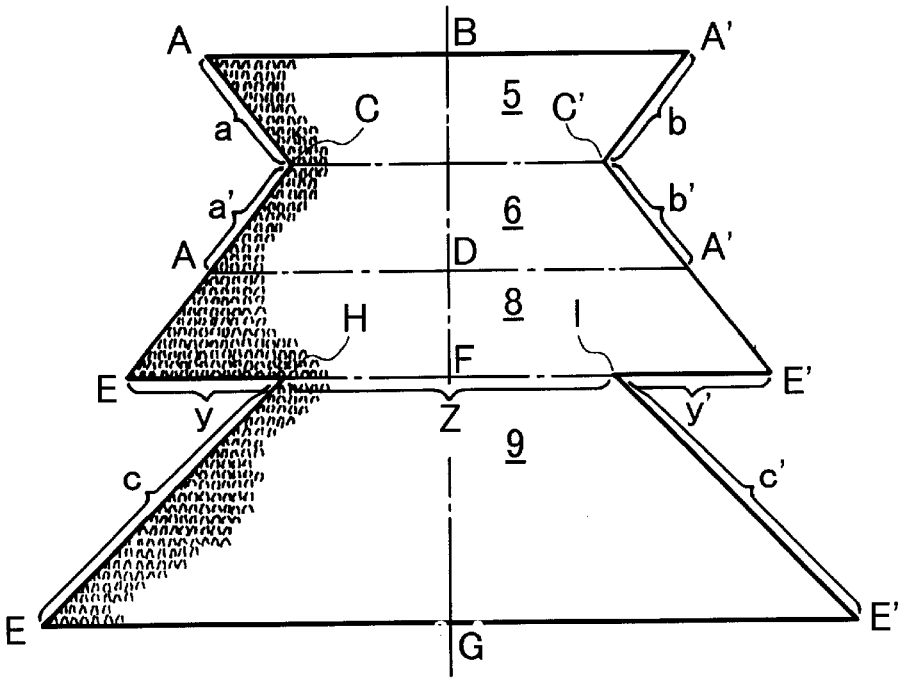
FIG. 6 is a plan view of still another knit fabric of a heel part.
Figure 7:
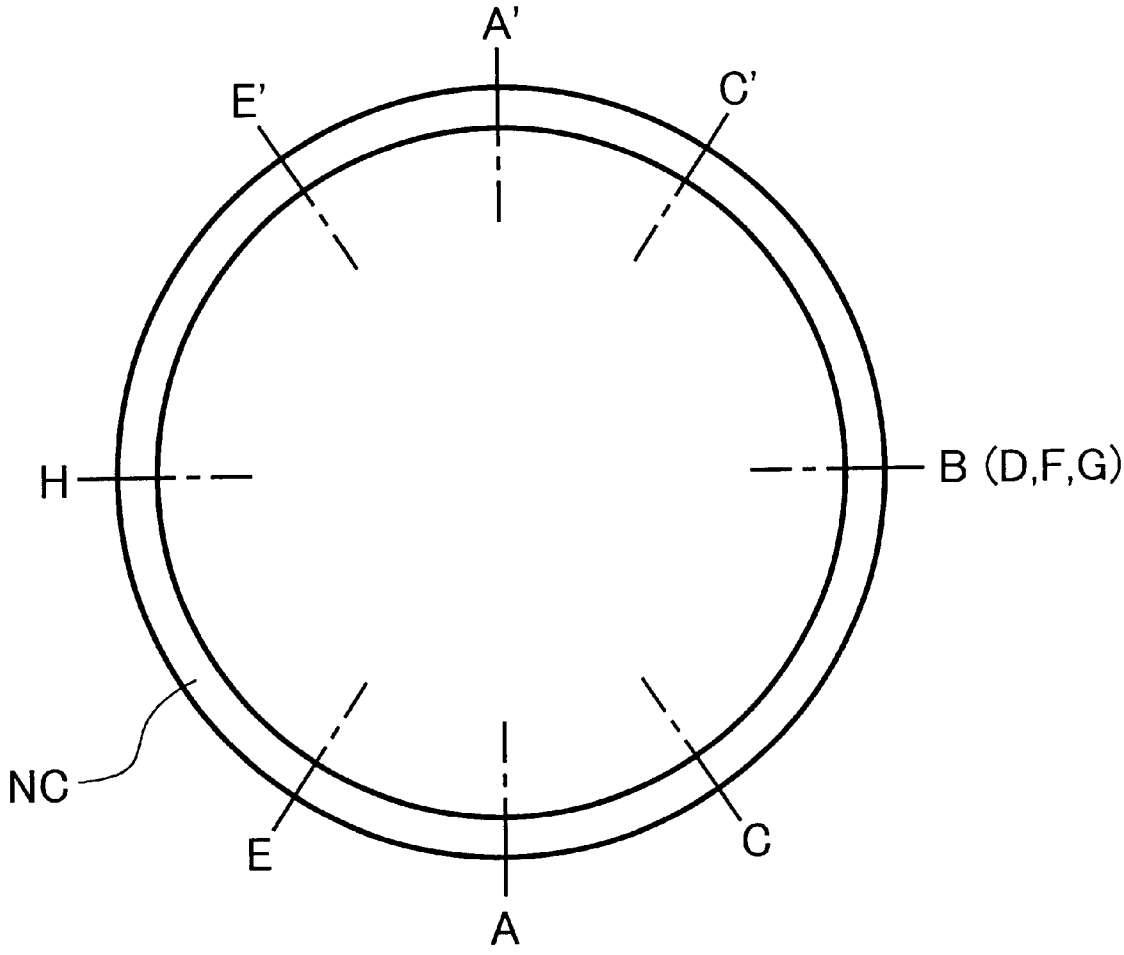
FIG. 7 is a schematic view of a cylinder of a circular knitting machine as viewed from below.

Then, next to the top side C, C' of the first trapezoidal knit fabric described above, a second trapezoidal knit fabric 6 within the range of C, C', A', A of the number of courses equal to that of the first trapezoidal knit fabric 5 is knitted now conversely by successively increasing the stitches of one course one by one stitch at the opposite ends of the fabric for each one reciprocating motion beginning with C, C'. The second trapezoidal knit fabric 6 has the top side C, C' commonly with the first trapezoidal knit fabric 5. Upon knitting of the second trapezoidal knit fabric 6, a loop at an end portion of each course which forms an inclined edge a' of the second trapezoidal knit fabric 6 is knitted by a needle which held a loop of an end wale of the course which forms the inclined edge a upon knitting of the first trapezoidal knit fabric 5 and has been raised at the inoperative position, and the new and old loops are connected together by knitting. In particular, the inclined edges a and a' and the inclined edges b and b' of the first and second trapezoidal knit fabrics 5 and 6 shown in FIGS. 4, 5 and 6 are individually integrated with each other so that a tubular knit fabric is formed. A line produced from the inclined edge a and the inclined edge a' integrated with each other is a first gore line 7, and another line produced from the inclined edge b and the inclined edge b' integrated with each other is another first gore line 7' (not shown), and the gore lines 7, 7' extend obliquely downwardly from upper portions of the heel part toward rear portions of the heel part. Consequently, the first and second trapezoidal knit fabrics 5, 6 form a tubular portion S1. In the present invention, forward portions of the heel part with respect to the first gore lines 7, 7' and extension lines of them have greater areas and greater surpluses than rearward portions of the heel part so that the entire heel part 4 has a sufficient swell and a sufficient space. To this end, third and fourth trapezoidal knit fabrics 8, 9 (shown in FIGS. 1 and 2, and FIGS. 4, 5 and 6) including second gore lines 10, 10', 110, 110' (10' and 110' are not shown) are knitted as hereinafter described.

An example of first embodiment of the second gore lines 10, 10' is described below.

In particular, next to a course A, D, A' of the bottom side of the second trapezoidal knit fabric 6, the first course of the third trapezoidal knit fabric 8 is knitted. The course in the beginning of knitting is knitted using those needles which have knitted the last course of the second trapezoidal knit fabric 6 (that is, since the last course described is knitted with the needles between A, B, A' of FIG. 7, needles at the ends) and additional needles adjacent the needles, and thereafter, reciprocating knitting is performed while adjacent needles are successively added to the needles. The needles between AE, A'E' including adjacent needles other than the needles between A, B, A' which have knitted the second trapezoidal knit fabric 6 described above are in the raised inoperative position, and thereafter, at end portions of knitting of each course, a needle between AE and another needle between A'E' which have been in the inoperative position are successively lowered to the knitting position to perform reciprocating knitting. Then, as knitting of courses from A to E and from A' to E' shown in FIGS. 4, 5 and 6 proceeds, the number of wales in each course successively increases, and knitting of the third trapezoidal knit fabric 8 comes to an end at the positions E, E' shown FIG. 4. The reversal ends (between AE and between A'E') of the reciprocating knitting described above coincide with the last course of the leg part 3, and loops of the course and loops at the reversal ends of the reciprocating knitting are connected by knitting integrally with each other, and the third trapezoidal knit fabric 8 is knitted up to the last course E, F, E' thereof.

Thereafter, knitting of the fourth trapezoidal knit fabric 9 is started. Next to the last course of the third trapezoidal knit fabric 8, knitting is started from the starting end point E and is reversed suitably at one point by a suitable number of wales forwardly of the other end E'. Then, needles of a suitable number of wales yy' (shown in FIG. 4) from the opposite side edges of the E, F, E' course of the third trapezoidal knit fabric are raised and placed at the inoperative position, and knitting of the fourth trapezoidal knit fabric 9 is started with needles of the remaining wales Z between H and I contiguously to the third trapezoidal knit fabric 8. Also in the present knitting, the knitting width is increased for each one reciprocating motion (the last number thus increased is equal to that of the wales y, y'), and the increased stitches are knitted integrally with the third trapezoidal knit fabric 8 by those needles which have knitted the wales y, y' of the third trapezoidal knit fabric 8. The wales y, y' of the third trapezoidal knit fabric 8 and the inclined edges c, c' of the fourth trapezoidal knit fabric 9 are connected by knitting integrally with each other and form the second gore lines 10, 10' (10' is not shown). The gore lines 10, 10' are positioned adjacent the foot part side with respect to the first gore lines and extend obliquely downwardly from upper front portions of the heel part toward the center of the heel part. As the length of the second gore lines 10, 10' increases, the number of courses from the top side to the bottom side of the fourth trapezoidal knit fabric increases and such a very great ease is provided at the third and fourth trapezoidal knit fabrics 8, 9 that they tenderly embraces the heel of a foot, and slipping down of the heel part 4 which is caused by closeness of the heel part 4 can be prevented. However, if the number of courses of the third trapezoidal knit fabric 8 is increased in order to increase the ease described above, then the distance between the second gore lines 10, 10' and the first gore lines 7, 7' may become so great that the ease of the knit fabric between the second and third trapezoidal knit fabrics may possibly be lost conversely. Therefore, it is not necessarily better to increase the number of courses of the third trapezoidal knit fabric 8 as much as possible. Finally, the last course E, G, E' of the fourth trapezoidal knit fabric 9 has an equal width to that of the last course E, F, E' of the third trapezoidal knit fabric 8, and the opposite ends E, E' of the last course of the third trapezoidal knit fabric coincide with the opposite ends E, E' of the last course of the fourth trapezoidal knit fabric.

Figure 2:
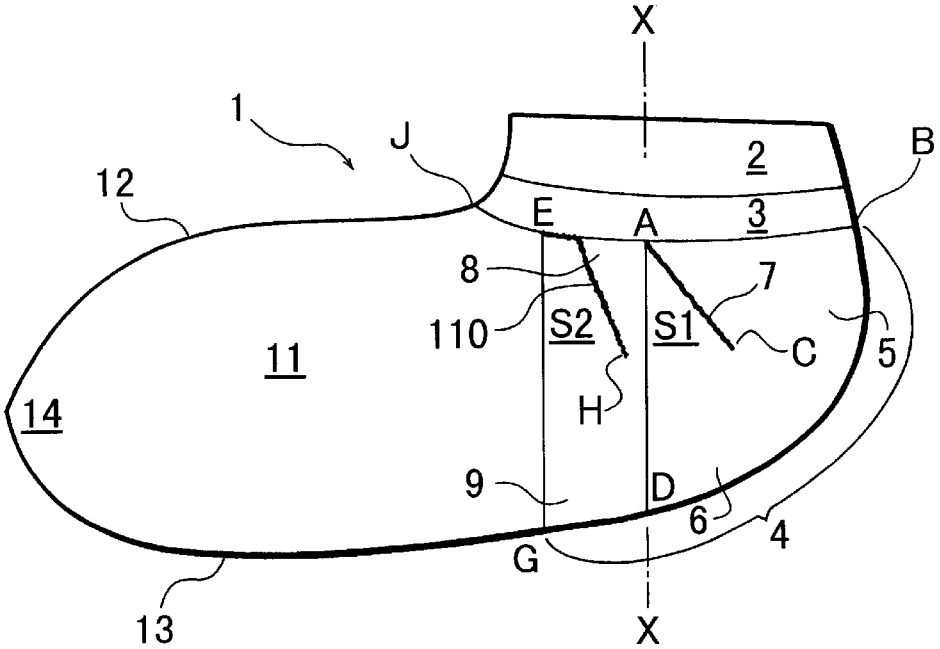
FIG. 2 is a side view of another embodiment of socks of the present invention.
Figure 3:
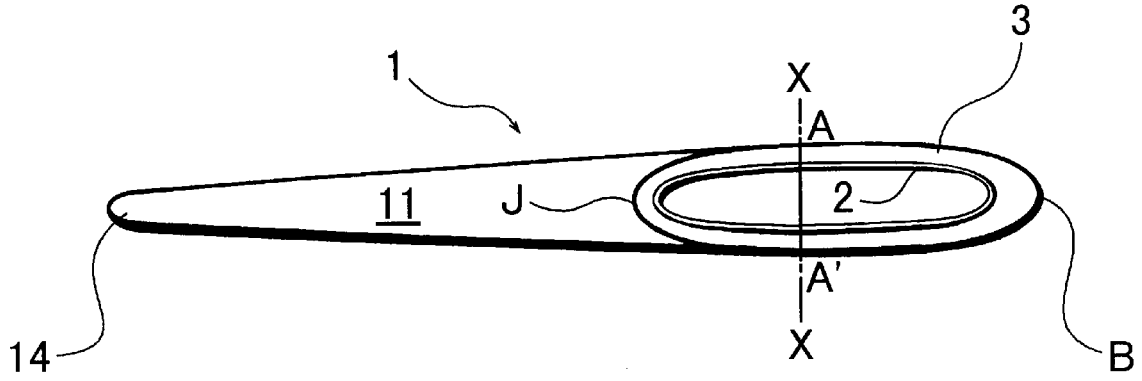
FIG. 3 is a schematic plan view of the socks.

An example of second embodiment of the second gore lines 110, 110' is described below with reference to FIGS. 2, 5 and 6.

In the present example, the numbers of courses of the third trapezoidal knit fabric 8 and the fourth trapezoidal knit fabric 9 are selected so that, when wales y, y' at the opposite side ends of the bottom side E, F, E' of the third trapezoidal knit fabric 8 and inclined sides c, c' of the fourth trapezoidal knit fabric 9 are connected together by knitting for formation of gore lines, surplus portions may be provided at end portions of the inclined sides c, c' of the fourth trapezoidal knit fabric 9. In particular, if the number of courses of the third trapezoidal knit fabric 8 is decreased as shown in FIG. 5, then the number of loops which are positioned on the inclined sides d, d' of the knit fabric 8 and are to be connected by knitting to the last course of the leg part 3 decreases, and if the shape of the fourth trapezoidal knit fabric 9 remains as it is, then resulting socks have a shorter distance between the two points A, E on the last course of the leg part 3 in the side view of the socks shown in FIG. 1. Then, the numbers of the wales y, y' at the opposite ends of the bottom side E, F, E' of the third trapezoidal knit fabric 8 become small, and when the bottom side E, F, E' of the third trapezoidal knit fabric 8 is connected to the inclined sides c, c' of the fourth trapezoidal knit fabric 9, the oblique sides c, c' are so long that a surplus is produced in courses of the inclined sides c, c' of the fourth trapezoidal knit fabric 9 near to the bottom side E, G, E'. In the surplus portions, loops at end portions of the surplus courses are successively connected by knitting to loops of the last course of the leg part. By the knitting connection, the gore lines 110, 110' integrated with part of the last course of the leg part 3 are formed. Further, if the number of courses of the fourth trapezoidal knit fabric 9 is increased while the third trapezoidal knit fabric 8 remains as it is as shown in FIG. 6, then the distance between A, E does not vary. While, in any of the examples of FIGS. 5 and 6, the gore lines 110, 110' which extend obliquely downwardly rearwards from the point E can be produced, since, in either case, the surplus portions are produced at end portions of the inclined sides c, c' of the fourth trapezoidal knit fabric 9 described above, the surplus portions are connected by knitting to the last course of the leg part 3. Therefore, in the second example, upper end portions of the gore lines 110, 110' are formed integrally with the last course of the leg part 3 and the entire gore lines 110, 110' are bent in an L-shape.

In any of the gore line knitting methods described above, if the inclination of the inclined sides of the trapezoidal knit fabric 8 is made moderate (if the number of stitches to be increased at the end portions of the reciprocating courses is increased), then when the fabric is knitted into socks, the length between the last course of the leg part and the sole part shown in FIG. 1 can be increased suddenly between AE, which contributes very much to generation of the ease at the portion.

Thereafter, next to the knitting end course E, E, E' of the fourth trapezoidal knit fabric 9 and the knitting end course E, J, E' of the leg part 3 on an instep part 12 side, cylindrical knitting of the instep part 12 and a sole part 13 by circumferential motions and knitting of the toe 14 by an ordinary method are performed, and the opening at the toe 14 is closed up by linking or some other countermeasure, thereby completing a product.

Although socks which have the first gore lines 7, 7' produced between the first trapezoidal knit fabric 5 and the second trapezoidal knit fabric 6 described above are found conventionally, in the socks of the present invention, the third trapezoidal knit fabric 8 wherein loops at end edges thereof are connected by knitting to loops of the last course of the leg part and the fourth trapezoidal knit fabric which forms the second gore lines 10, 10' or 110, 110' together with the third trapezoidal knit fabric 8 are knitted next to the second trapezoidal knit fabric 6. Further, the length of the bottom side of the third trapezoidal knit fabric is made greater than that of the second trapezoidal knit fabric 6 such that the length of an arc which forms the heel increases as knitting proceeds (maximum E, E') to make the range of the heel part 4 great. Furthermore, the fourth trapezoidal knit fabric is provided next to the third trapezoidal knit fabric, and while the lengths of the bottom sides of the third trapezoidal knit fabric and the fourth trapezoidal knit fabric are equal to each other, the second gore lines 10, 10' or 110, 110' are formed between them to provide a swelling portion S2 which provides the basis for an ease to the portion to give rise to an effect of increasing the swell of the heel.

Therefore, when the socks of the present invention are put on, the heel portion of the foot is embraced with an ease by the heel part 4 having a large arcuate plane, and slipping down of the socks does not occur.

Since the ankle socks have the operation and effects described above, even if the number of courses of the knit fabric at the rib top part is decreased, the rib top part is not pulled down into shoes, and the degree over which the rib top portion of the socks are exposed from the top-line of the shoes can be reduced in advance and a good appearance when the socks are put on can be assured because such slipping down as described above does not occur.

Since the socks of the present invention have a heel part of an increased range and have two trapezoidal knit fabrics for a heel part construction including first gore lines extending rearwardly downwards from a central portion of the heel part as well as second gore lines provided adjacent the foot side, the range of the heel part is expanded and the heel part has an ease. Consequently, the socks embrace a heel portion tenderly over a wide range, and when they are put on, it can provide a stable wearing feeling without suffering from slipping down of the heel part.

What is claimed is:

1. A sock having a rib top part, a leg part, a heel part, a foot part and a toe part which are knitted in order, including:

a tubular portion having first gore lines which extend obliquely downwardly from upper portions of the heel part to rear portion of the heel part and are formed on the heel part next to the leg part from first and second trapezoidal knit fabrics whose top sides are common to each other; and a swelling portion having second gore lines which are nearer to the foot part than said first gore lines, extend obliquely downwardly from upper front portions of the heel part to central portions of the heel part and are formed from a third trapezoidal knit fabric having a top side whose length is equal to the length of a bottom side of the second trapezoidal knit fabric and having inclined sides connected by knitting to the last course of the leg part and a fourth trapezoidal knit fabric having a top side contiguous to a mid portion of a bottom side of the third trapezoidal knit fabric.

2. A sock according to claim 1, wherein said first gore lines are formed by commonly knitting opposing loops of opposing inclined faces of the first trapezoidal knit fabric and the second trapezoidal knit fabric, and said second gore lines are formed by connecting by knitting, opposing loops at end portions of a course which forms the bottom side of the third trapezoidal knit fabric and on the inclined sides of the fourth trapezoidal knit fabric which oppose to the bottom side of the third trapezoidal knit fabric.

3. A sock according to claim 1, wherein said second gore lines are bent in an L-shape and are formed by connecting opposing loops at end portions of a course which forms the bottom side of the third trapezoidal knit fabric and on the inclined sides of the fourth trapezoidal knit fabric which oppose to the bottom side of the third trapezoidal knit fabric and surplus loops which appear with the loops on the inclined sides are connected by knitting to the loops of the last course of the leg part.

4. A knitting method for a sock having a rib top part, a leg part, a heel part, a foot part and a toe part which are knitted in order, comprising steps of:

connecting inclined sides of a first trapezoidal knit fabric having a bottom side knitted next to the leg part to a second trapezoidal knit fabric having a top side common to that of the first trapezoidal knit fabric by knitting to form a tubular portion having first gore lines extending obliquely downwardly from upper portions of the heel part to rear portions of the heel part; and connecting a third trapezoidal knit fabric having a top side whose length is equal to the length of a bottom side of the second trapezoidal knit fabric and which is knitted next to the second trapezoidal knit fabric such that inclined sides thereof are connected by knitting to the last course of the leg part, to a fourth trapezoidal knit fabric having a top side which is a mid portion of a bottom side of the third trapezoidal knit fabric and being knitted contiguously to the third trapezoidal knit fabric such that inclined sides of the fourth trapezoidal knit fabric are connected by knitting to wales at end portions of a course of a bottom side of the third trapezoidal knit fabric, to form a swelling portion having second gore lines extending obliquely downwardly from upper front portions of the heel part to central portions of the heel part between the bottom side of the third trapezoidal knit fabric and the inclined sides of the fourth trapezoidal knit fabric.

5. A knitting method for a sock according to claim 4, wherein if surplus portions appear at the inclined sides of the fourth trapezoidal knit fabric upon connecting by knitting of the inclined sides of the fourth trapezoidal knit fabric to wales at end portions of a course of a bottom side of the third trapezoidal knit fabric, loops at end portions of the surplus portions are successively connected by knitting to loops of the last course of the leg parts to form a swelling portion having another second gore lines bent in an L-shape.

* * * * *